US007241002B1

(12) United States Patent
Sasaki

(10) Patent No.: US 7,241,002 B1
(45) Date of Patent: Jul. 10, 2007

(54) INK CARTRIDGES

(75) Inventor: Toyonori Sasaki, Anjo (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 0 days.

(21) Appl. No.: 11/536,661

(22) Filed: Sep. 29, 2006

Related U.S. Application Data

(60) Provisional application No. 60/826,254, filed on Sep. 20, 2006.

(30) Foreign Application Priority Data

Mar. 30, 2006 (JP) ..... 2006-095663

(51) Int. Cl.
*B41J 2/175* (2006.01)

(52) U.S. Cl. ..... 347/86

(58) Field of Classification Search ..... 347/7, 347/84–86; 382/108; 73/1.89, 105

(56) References Cited

U.S. PATENT DOCUMENTS 6,796,627 B2 9/2004 Kimura et al.
2005/0068389 A1* 3/2005 Katayama et al. ..... 347/86

* cited by examiner

*Primary Examiner*—Stephen Meier
*Assistant Examiner*—Geoffrey S. Mruk
(74) *Attorney, Agent, or Firm*—Baker Botts, L.L.P.

(57) ABSTRACT

An ink cartridge include an ink chamber including a wall, and a translucent portion positioned at the wall. The translucent portion has an inner space formed therein. The ink cartridge also includes a movable member including a first member disposed within the inner space of the translucent member, and a second member disposed within the ink chamber. Either a surface of the first member or an interior surface of the translucent portion, or both, includes a first surface portion and a second surface portion, and the second surface portion is raised with respect to the first surface portion.

14 Claims, 10 Drawing Sheets

INK CARTRIDGES

CROSS-REFERENCE TO RELATED APPLICATIONS

The present application claims priority from Japanese Patent Application No. JP-2006-095663, which was filed on Mar. 30, 2006, and U.S. Provisional Patent Application No. 60/826,254, which was filed on Sep. 20, 2006, the disclosures of which are incorporated herein by reference in their entirety.

BACKGROUND OF THE INVENTION

1. Field of the Invention

The present invention relates generally to ink cartridges. In particular, the present invention is directed towards ink cartridges which may be used in combination with printers.

2. Description of Related Art

Ink cartridges which are configured to be used in combination with ink jet printers are known in the art. In such known ink cartridges, it is possible to detect when the amount of ink in the ink cartridge is relatively low. For example, one known ink cartridge comprises a movable member which is pivotally supported inside an ink reservoir. The movable member has a blocking portion at one end and a float portion at the other end. When the ink reservoir is filled with ink, the rotation of the movable member due to the rising of the float portion in the vertical direction is restricted by a stopper, such that the blocking portion is positioned at the blocking position, where the blocking portion may block light emitted from an ink jet printer. When the surface level of the ink is lowered, the position of the float in the vertical direction also is lowered, and the position of the blocking portion in the vertical direction rises, thereby moving the blocking portion from the blocking position to a non-blocking position. Thus, the printer then may determine that the ink cartridge includes substantially no ink, and the ink cartridge needs to be replaced.

Nevertheless, if the ink cartridge vibrates when the printer is transported with the ink cartridge installed, or the like, ink bubbles may form inside the ink reservoir. When bubbles form inside the ink reservoir, the rotation of the movable member may be hindered by the surface tension of bubbles adhering to the inner wall surface of the ink reservoir, such that an out-of-ink state may be detected when there is sufficient ink within the ink reservoir. Moreover, it may take several hours for the bubbles to sufficiently disappear, such that the movable member accurately may rotate in accordance with the amount of ink within the ink reservoir.

SUMMARY OF THE INVENTION

Therefore, a need has arisen for ink cartridges that overcome these and other shortcomings of the related art. A technical advantage of the present invention is that the ink cartridge may be configured to reduce the amount of time between when bubbles appear within the ink reservoir and when such bubbles sufficiently disappear from the ink reservoir, such that the movable member accurately may rotate in accordance with the amount of ink within the ink reservoir.

According to an embodiment of the present invention, an ink cartridge comprises an ink chamber comprising a wall, and a translucent portion positioned at the wall. The translucent portion has an inner space formed therein. The ink cartridge also comprises a movable member comprising a first portion disposed within the inner space of the translucent member, and a second portion disposed within the ink chamber. The first portion comprises at least one fist protrusion portion formed on a first surface of the first portion, which extends towards an interior surface of the inner space. Moreover, at least a portion of the first portion of the movable member has a surface having a first surface roughness, and at least a portion of the second portion of the movable member has a surface with a second surface roughness, and the first surface roughness is greater than the second surface roughness. In addition, the protrusion portion extends further towards the interior surface of the inner space than the portion of the first portion which has the first surface roughness.

According to another embodiment of the present invention, an ink cartridge comprises an ink chamber comprising a wall, and a translucent portion positioned at the wall. The translucent portion has an inner space formed therein. The ink cartridge also comprises a movable member comprising a first portion disposed within the inner space of the translucent member, and a second portion disposed within the ink chamber. Moreover, at least a portion of the first portion of the movable member and at least a portion of the second portion of the movable member comprises a roughened surface.

According to yet another embodiment of the present invention, an ink cartridge comprises an ink chamber comprising a wall, and a translucent portion positioned at the wall. The translucent portion has an inner space formed therein. The ink cartridge also comprises a movable member comprising a first member disposed within the inner space of the translucent member, and a second member disposed within the ink chamber. Moreover, at least one of the first member and an interior surface of the translucent portion comprises at least one protrusion portion, and at least one of a surface of the first member and the interior surface of the translucent portion comprises a first surface portion and a second surface portion, in which the second surface portion is raised with respect to the first surface portion.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

FIGS. 5(*c*) and 5(*d*) are drawings of a second arm according to another embodiment of the present invention.

DETAILED DESCRIPTION OF EMBODIMENTS

Embodiments of the present invention and their features and technical advantages may be understood by referring to FIGS. 1-9, like numerals being used for like corresponding portions in the various drawings.

Figure 1:
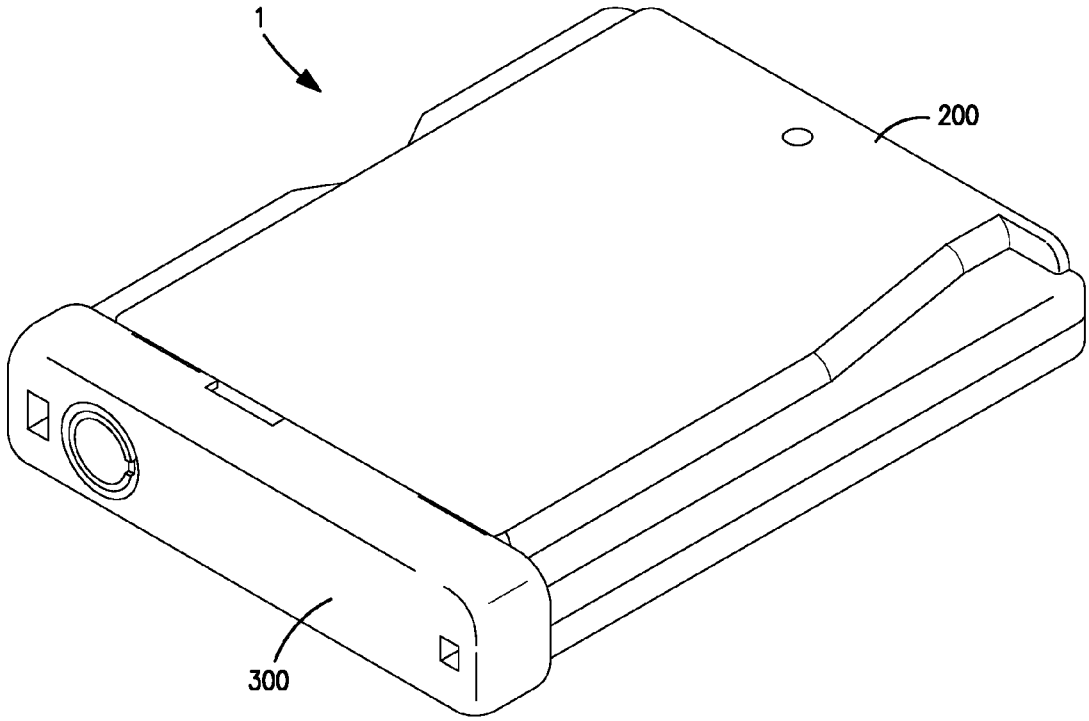
FIG. 1 is a perspective view of an ink cartridge, according to an embodiment of the present invention.
Figure 2:
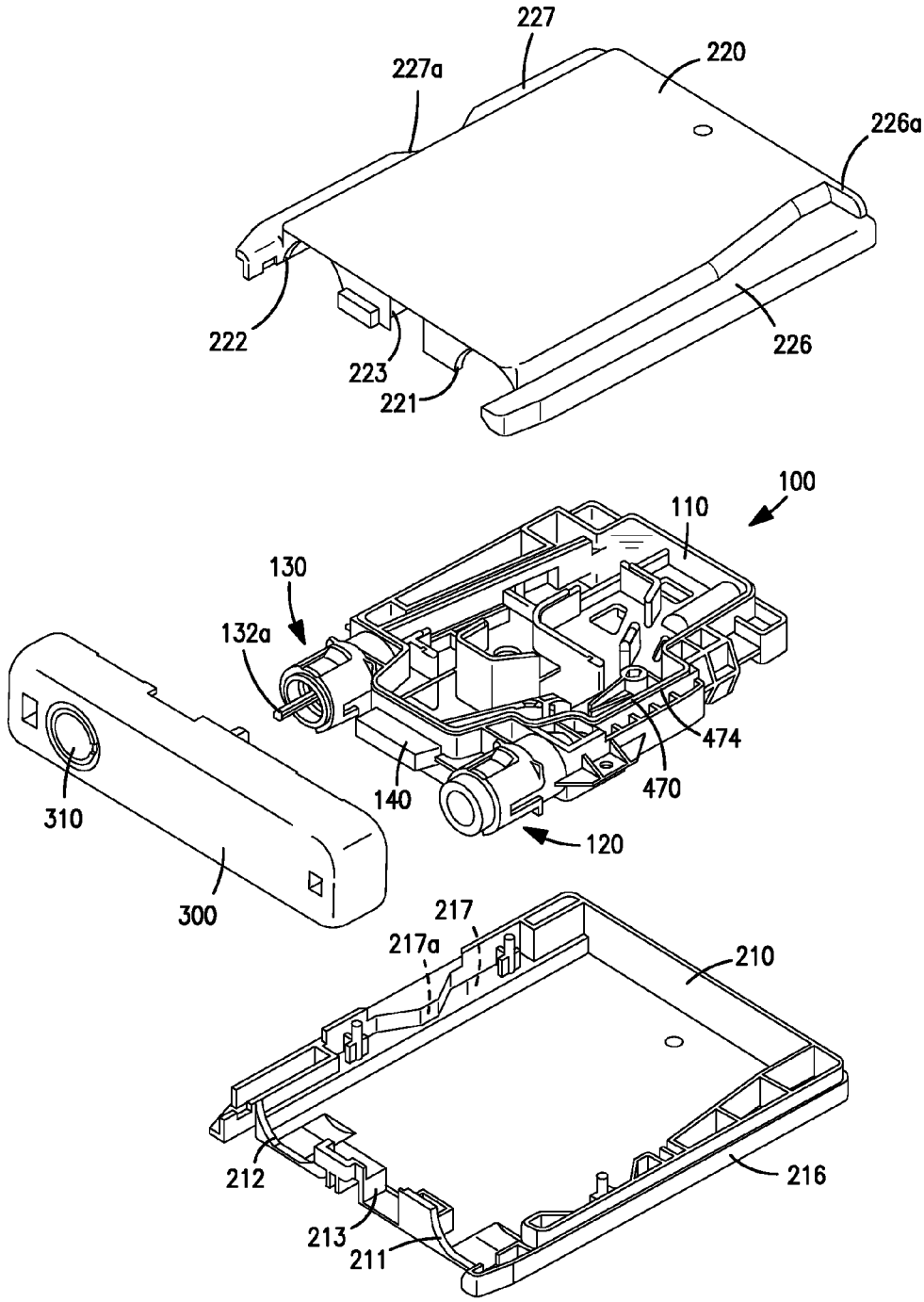
FIG. 2 is an expanded view of the ink cartridge of FIG. 1.

Referring to FIGS. 1 and 2, an ink cartridge 1 may comprise a case 200 which substantially encloses an ink storage element 100 which stores ink, and a protector 300 which may be attached to case 200 and may protect ink storage element 100 when ink cartridge 1 is transported. Ink storage element 100, case 200, and protector 300 may comprise a resin material, e.g., nylon, polyethylene, polypropylene, or like, and may not comprise any metal materials, such that they may be incinerated for waste disposal.

Ink cartridge 1 may have a substantially hexahedron shape, and may comprise a plurality of surfaces, e.g., six surfaces. The plurality of surfaces may comprise a pair of substantially rectangular surfaces with a largest area, a pair of side surfaces, and a pair of linking surfaces.

Figure 3:
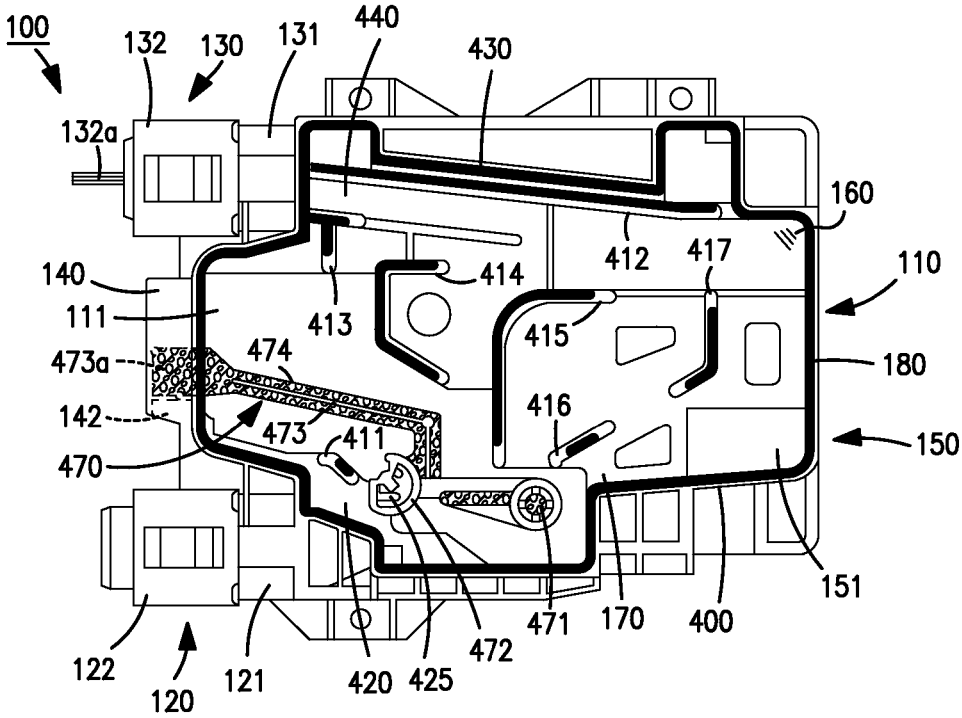
FIG. 3 is a drawing of an ink storage element of FIG. 2.
Figure 4A:
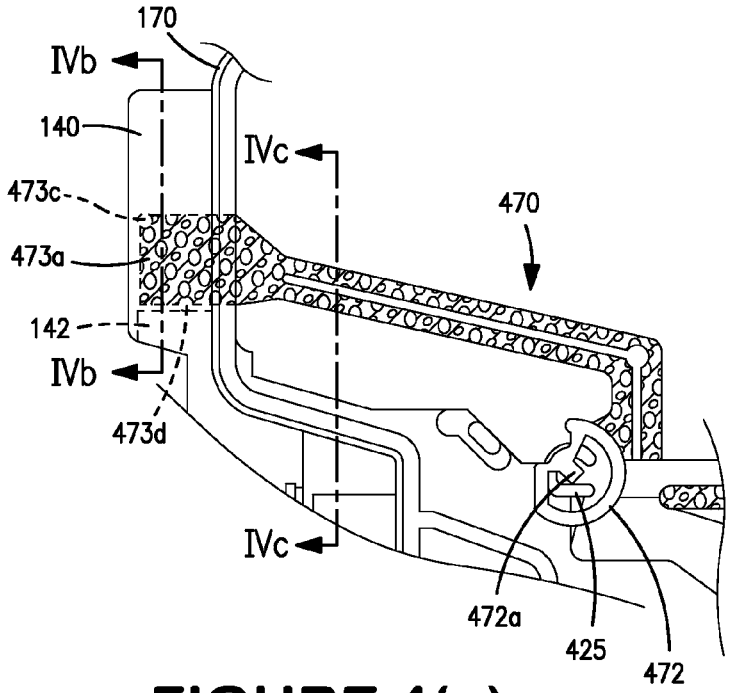
FIGS. 4(*a*)-4(*f*) are drawings of an area adjacent to a translucent portion of FIG. 3.
Figure 4B:
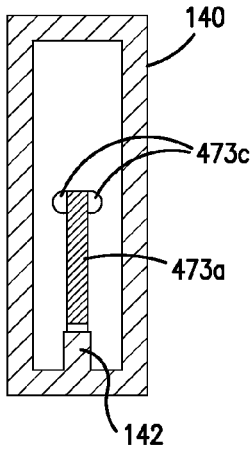
Figure 4C:
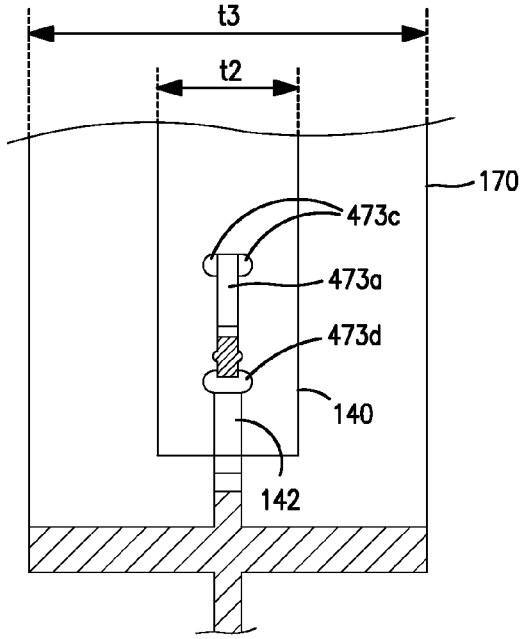
Figure 4D:
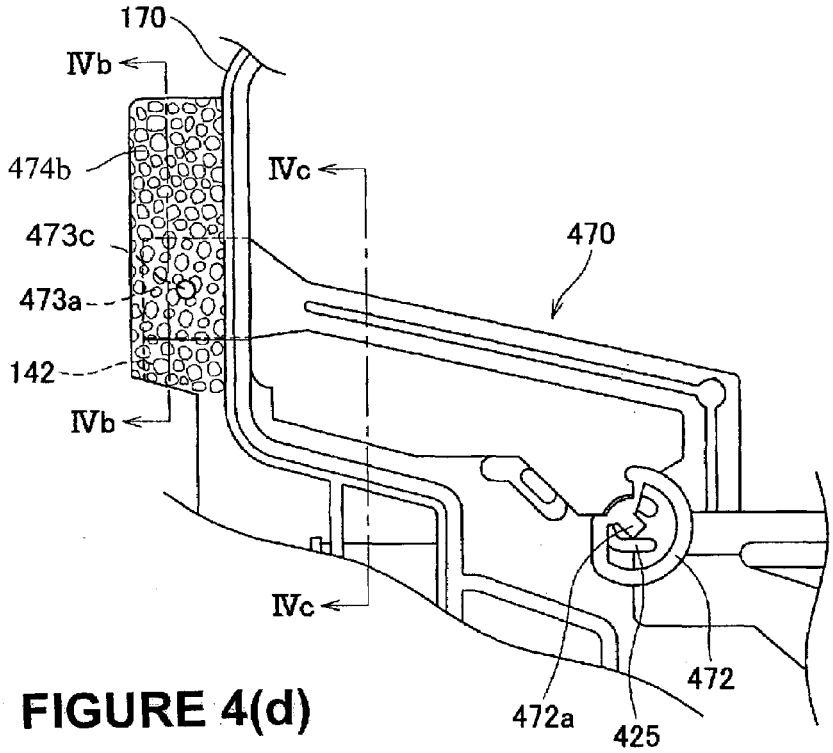
Figure 4E:
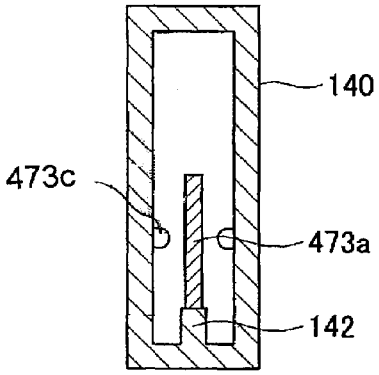
Figure 4F:
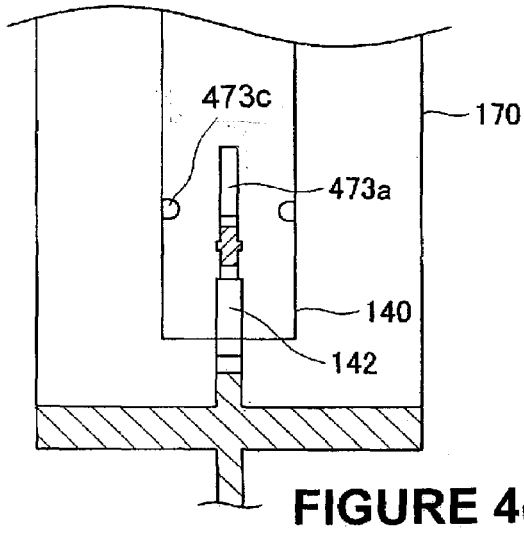
Figure 5A:
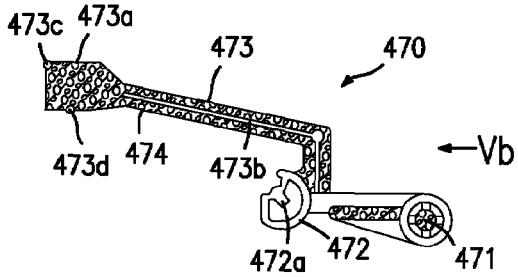
FIGS. 5(*a*) and 5(*b*) are drawings of a movable member of FIG. 3.
Figure 5B:
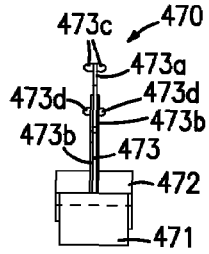
Figure 5C:
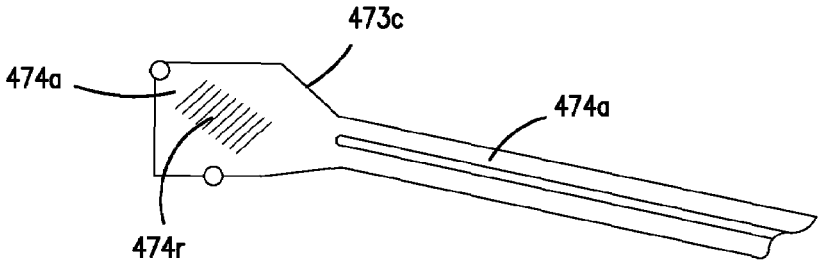
Figure 5D:
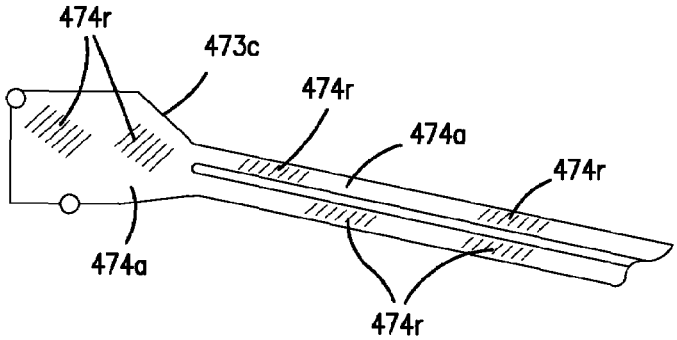

Referring to FIG. 3, ink storage element 100 may comprise an ink reservoir 110 comprising an ink chamber 111 for storing ink therein, an ink supply portion 120 for supplying ink stored in ink reservoir 110 to an outside of ink reservoir 110, an ambient air intake portion 130 for drawing in ambient air into ink reservoir 110, and an ink dispensing portion 150 for dispensing ink into ink reservoir 110.

Ink reservoir 110 may comprise a main body portion 170 and a translucent portion 140. Translucent portion 140 may project from main body portion 170 between ink supply portion 120 and ambient air intake portion 130, and may have an inner space formed therein. Specifically, ink supply portion 120, ambient air intake portion 130, and translucent portion 140 may be provided on same wall surface of ink storage element 100. Moreover, a movable member 470 may be positioned within ink reservoir 110, which may be configured to pivot about a pivot member provided in the vicinity of the left bottom portion of ink reservoir 110 adjacent to ink supply portion 120. Movable member 470 may comprise a resin material, e.g., styrene resin, with a specific gravity which is less than the specific gravity of ink, and movable member 470 may be manufactured by injection molding.

Referring to FIG. 5(*a*), movable member 470 may be a pivoting member which is pivotally supported within ink reservoir 110 and pivots in response to an amount of ink within ink reservoir 110. Movable member 470 may comprise an attachment portion 472 comprising an attachment shaft 472*a* which may be attached to a substantially C-shaped arm sandwiching portion 425 provided on main body portion 170. Movable member 470 also may comprise a float portion 471 positioned on the right side of attachment portion 472, and an arm portion 473 which extends substantially vertically from attachment portion 472 to float portion 471 and the extends further upward in sloping fashion. The volume of float portion 471 may be substantially greater than the volume of arm portion 473. A first end of arm portion 473 may comprise blocking portion 473*a*. Blocking portion 473*a* may have a plate shape with a surface parallel to the surface of the paper in FIG. 5(*a*), and may be positioned within the inner space of translucent portion 140. Moreover, a second end of arm portion 473 may comprise float portion 471, and arm portion may pivot about attachment portion 472.

A distance between attachment portion 472 and blocking portion 473*a* may be greater than a distance between attachment portion 472 and float portion 471. The rotation of movable member 470 in the clockwise direction may be restricted by contact of float portion 471 with the bottom wall of ink reservoir 110. Moreover, the rotation of movable member 470 in the counterclockwise direction may be restricted by contact of blocking portion 473*a* with a stopper 142. As such, movable member 470 may pivot within a predetermined pivoting path.

A rib 473*b* may be provided in arm portion 473, which protrudes in the width direction, i.e., the left-right direction in FIG. 5(*b*), and increases the strength of arm portion 473. A pair of substantially hemispherical arm protrusion portions 473*c* and 473*d*, e.g., a pair of pins, may be provided at top and the bottom of blocking portion 473*a*, respectively. Alternatively, referring to FIGS. 4(*d*)-4(*e*), protrusion portion 473*c* may extend from an interior surface of translucent portion 140, such that protrusion portion 474*c* extends towards moveable member 470. Moreover, because arm protrusion portions 473*c* and 473*d* may have a substantially hemispherical shape, portions that contact the inner wall of translucent portion 140 only may be the ends of arm protrusion portions 473*c* and 473*d*, thus reducing the influence of the surface tension of the ink.

In an embodiment of the present invention, the volume ratio of arm portion 473 to float portion 471 may be selected, such that when float portion 471 is submerged within the ink, the moment in counterclockwise direction in FIG. 5(*a*) generated on movable member 470 by gravity and buoyancy is greater than the moment in clockwise direction, and when a portion of float portion 471 is exposed from the ink, buoyancy generated on float portion 471 decreases and the counterclockwise moment and the clockwise moment are substantially equal. Therefore, after a portion of float portion 471 has been exposed from the ink and the surface level of the ink moves further downward as the amount of ink decreases, float portion 471 moves downward following the surface level of the ink. When float portion 471 moves downward, arm portion 473 moves upward about the fulcrum of attachment shaft 472*a* of attachment portion 472.

Referring to FIG. 5(*a*), a diffusion surface 474 may be formed on a surface of movable member 470. For example, diffusion surface 474 may be formed on a portion of float portion 471 and on a portion of arm portion 473 excluding rib 473*b*.

Figure 6A:
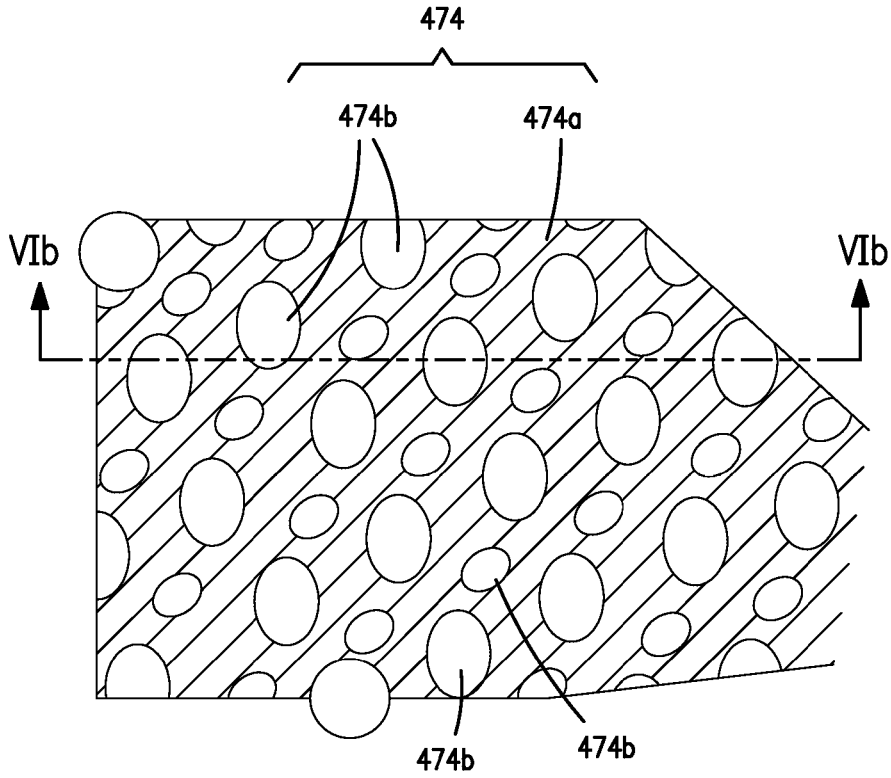
FIGS. 6(*a*) and 6(*b*) are drawings of a diffusion surface of FIGS. 5(*a*) and 5(*b*).
Figure 6B:
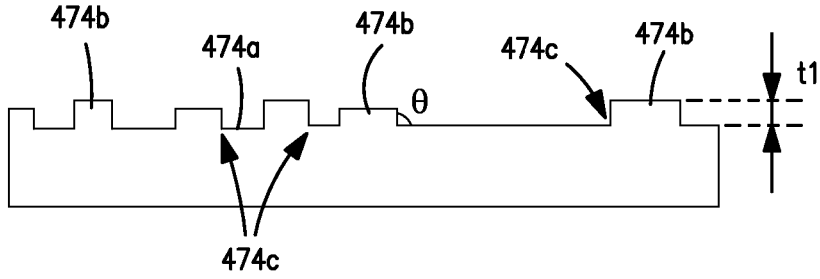

Referring to FIGS. 6(*a*) and 6(*b*) diffusion surface 474 may comprise a base surface 474*a*, e.g., a flat base surface, and a plurality of projecting portions 474*b* which project from base surface 474*a*, such that a first portion of diffusion surface 474, e.g., projecting portions 474*b*, is raised with respect to a second portion of diffusion surface, e.g., base surface 474*a*. Alternatively, referring to FIG. 4(*d*), projecting portion 474*b* may be raised with respect to and extend from an interior surface of translucent portion 140, such that projecting portions 474*b* extend towards movable member 470. The side surface of projecting portions 474*b* and base surface 474*a* may be connected at an angle θ, such that an angular corner portion 474*c* is formed therebetween. Consequently, corner portion 474*c* may generate a relatively strong capillary force. The shape of projecting portions 474*b* when viewed from the direction orthogonal to diffusion surface 474 may be varied rather than uniform, but each of projection portions 474*b* may be substantially circular. Moreover, the sizes of projecting portions 474*b* when viewed from the direction orthogonal to diffusion surface 474 also may be varied, and the length from base surface 474*a* to the tips of projecting portions 474*b* also may be varied.

In an embodiment of the present invention, the angle θ may be about 90 degrees, the length t1 from base surface 474*a* of diffusion surface 474 to the tips of projecting portions 474*b* may be between about 0.04 to about 0.06 mm, the mean diameter of projecting portions 474*b* may be about 0.8 mm and the area ratio of base surface 474*a* and projecting portions 474*b* may be about 0.5.

Moreover, the length of the gaps between adjacent projecting portions 474*b* may be sufficient to generate a capillary force on the ink when the ink is present in gaps, e.g., may be between about 0.4 mm and about 0.6 mm, or may be less than 0.4 mm. Therefore, the spaces between adjacent projecting portions 474*b* may be capillary force generating areas. The capillary force generating area between any two projecting portions 474*b* may be linked to other capillary force generating areas. Thus, a liquid on diffusion surface 474 may be diffused to other areas by the capillary force generated in the capillary force generating area where that liquid may be located. Moreover, if bubbles adhere to diffusion surface 474, ink comprising the bubbles may be diffused by the capillary forces on diffusion surface 474, such that bubbles disappear more rapidly relative to bubbles adhering to a smooth surface.

Referring to FIGS. 5(*c*) and 5(*d*), in another embodiment of the present invention, projecting portions 474*b* may be replaced by at least one roughened surface 474*r* which has a roughness which is greater than the roughness of base surface 474*a*. For example, in an embodiment, blocking portion 473*a* may comprise at least one roughened surface 474*r*, and the surface of substantially the remainder of arm portion 473 may comprise base surface 474*a*. In another embodiment, arm portion 473 may comprise a plurality of roughened surfaces 474*r*, and base surface 474*a* may be formed between roughened surfaces 474*r*. In either of these embodiments of the present invention, projection portions 473*c* and 473 may extend further towards an interior wall surface of translucent portion 140. The effect of using roughened surfaces 474*r* in combination with base surface 474*a* may be substantially similar to the effect of using projecting portions 474*b* in combination with base surface 474*a*.

Referring again to FIG. 3, main body portion 170 may comprise a frame portion 180 with edge portions at the front surface side and the back surface side of main body portion 170, and a film 160 welded to the front surface side and the rear surface side edge portions of frame portion 180. Specifically, a space for storing ink may be formed inside main body portion 170 by blocking the front surface side and the back surface side of frame portion 180 with film 160.

Frame portion 180 may comprise an outer peripheral weld portion 400 having a surface which is parallel to the width direction of ink reservoir 110. Frame portion 180 may comprise vertical walls that define the inner space of main body portion 170, inner weld portions 411-417 which may have a surface which is parallel to the width direction of ink reservoir 110 and may be arranged on the inside of outer peripheral weld portion 400, and linking portions 420, 430, and 440 which may have a surface which is orthogonal to the width direction of ink reservoir 110 and may link outer peripheral weld portion 400 and inner weld portions 411-417. Specifically, linking portion 420 may link outer peripheral weld portion 400 and inner weld portions 411 at the left bottom portion in FIG. 3, linking portion 430 may link outer peripheral weld portion 400 and inner weld portions 412 at the top portion in FIG. 3, and linking portion 440 may link outer peripheral weld portion 400 and inner weld portions 413-417 from the left to the right bottom portion in FIG. 3. In FIG. 3, the solid black portions of outer peripheral weld portion 400 and inner weld portions 411-417 may be located in same virtual plane, and film 160 may be weld by ultrasound welding to those portions. Moreover, linking portion 420 may be provided with an arm sandwiching portion 425 which sandwiches attachment portion 472 of movable member 470.

At least some of the vertical walls of inner weld portions 411-417 may extend in a direction which slopes down or may be substantially orthogonal to the long direction of frame portion 180, i.e., toward the bottom of ink cartridge 1, and the bottom ends thereof may not be connected to outer peripheral weld portion 400. Thus, even when a plurality of inner weld portions 411-417 are provided on the inside of outer peripheral weld portion 400, to prevent shrinkage of film 160 when film 160 is welded to frame portion 180, hindrance of ink flow by plurality of inner weld portions 411-417 may be reduced. Moreover, because inner weld portions 411-417 may be arranged on the inside of outer peripheral weld portion 400, shrinkage of film 160 may be reduced and hindrance of ink flow may be effectively decreased.

Referring to FIGS. 4(*a*)-4(*c*), translucent portion 140 may project outward from main body portion 170, and a space may be formed inside translucent portion 140, which is in communication with the inside of main body portion 170 and extends in an up-down direction. Blocking portion 473*a*, which may be provided on one end of movable member 470, may be arranged in the space inside translucent portion 140. Blocking portion 473*a* may be displaceable in an up-down direction inside translucent portion 140. Moreover, a stopper 142 which supports movable member 470 from below and restricts the displacement of movable member 470 may be provided inside translucent portion 140, and movable member 470 may be opaque.

Translucent portion 140 may be interposed between light emitting portion 1014*a* and light receiving portion 1014*b* of sensor 1014 when ink cartridge 1 is installed in printer 1000. The length t2 in width direction of translucent portion 140 may be shorter than length t3 in width direction of main body portion 170. Therefore, a gap between light emitting portion 1014*a* and light receiving portion 1014*b* of sensor 1014 may be relatively narrow, such that it is possible to detect blocking portion 473*a* with an inexpensive sensor.

Referring again to FIG. 3, ink supply portion 120 may comprise a cylindrical ink supply path 121 which communicates with ink reservoir 110 and extends in length direction, and an ink supply mechanism 122. A portion of ink supply mechanism may be inserted into ink supply path 121. Ink supply mechanism 122 may close the ink flow path when ink cartridge 1 is not installed in printer 1000, and may open the ink flow path when ink cartridge 1 is installed in printer 1000. Therefore, ink supply portion 120 may be configured to supply ink from the inside ink reservoir 110 to printer 1000 when ink cartridge 1 is installed in printer 1000.

Ambient air intake portion 130 may comprise a cylindrical ambient air communication passage 131, which communicates with ink reservoir 110 and extends in the long direction, and an ambient air intake mechanism 132 which may comprise a rod-shaped valve opening portion 132*a* projecting outside ambient air communication passage 131. Ambient air intake mechanism 132 may be configured to close ambient air flow path when ink cartridge 1 is not installed in printer 1000, and may be configured to open ambient air flow path when ink cartridge 1 is installed in printer 1000.

Ink dispensing portion 150 may comprise a dispensing cylinder portion 151 provided near the bottom at the side surface opposite side surface on which ink supply portion 120 and ambient air intake portion 130 may be provided, and an ink dispensing cap (not shown) which may be press-fitted into dispensing cylinder portion 151. A communication hole (not shown) which places dispensing cylinder portion 151 and ink reservoir 110 in communication may be formed in dispensing cylinder portion 151. The ink dispensing cap may comprise an elastic material, such as butyl rubber.

Figure 8A:
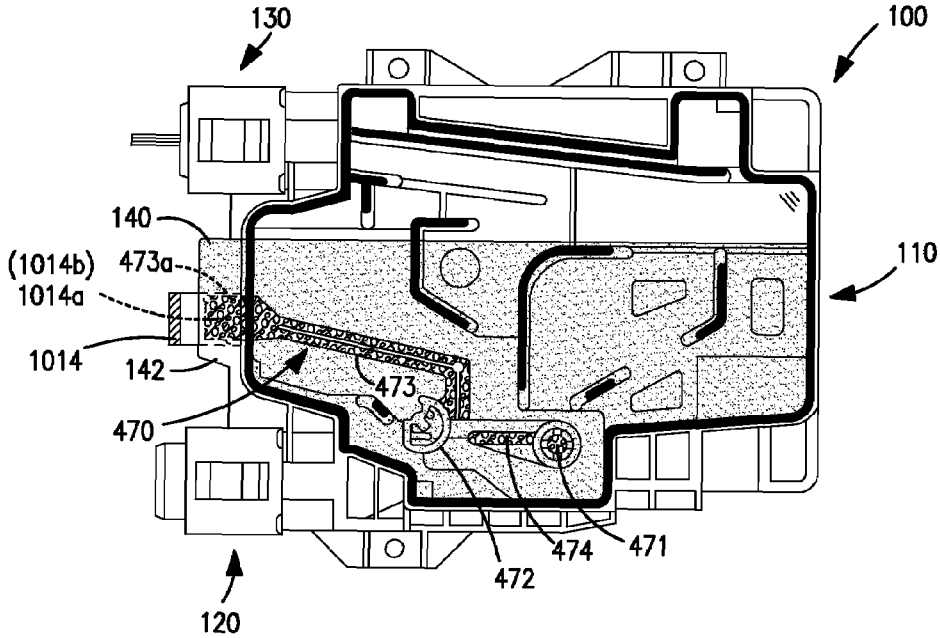
FIGS. 8(*a*) and 8(*b*) are drawings depicting a method of detecting the amount of ink in an ink reservoir of FIG. 5.
Figure 8B:
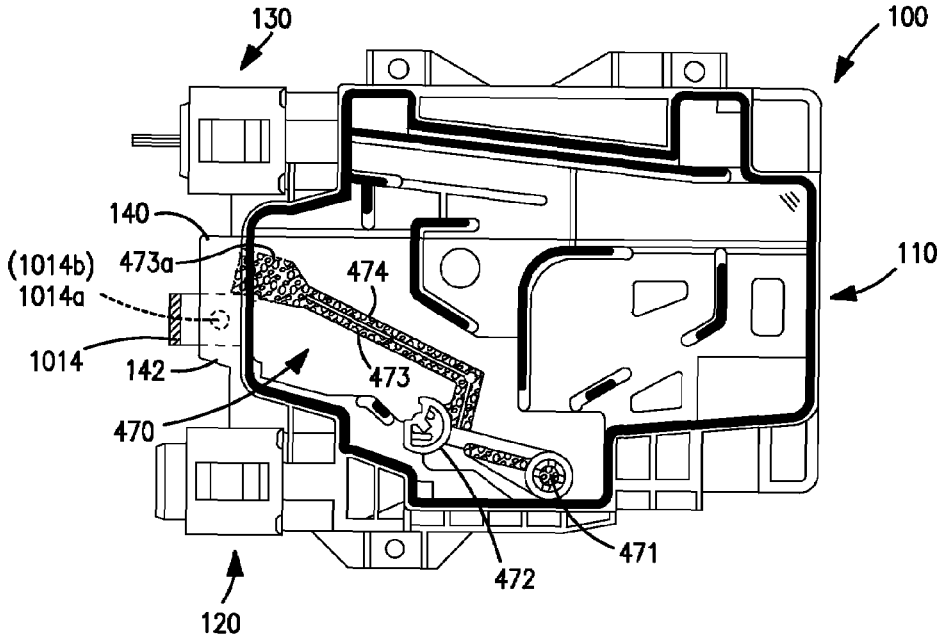

Referring to FIGS. 8(*a*) and 8(*b*), when a large amount of ink is stored in ink reservoir 110, float portion 471 floats in ink, and blocking portion 473*a* may be positioned at a blocking position which obstructs the space between light emitting portion 1014*a* and light receiving portion 1014*b* of sensor 1014. When the ink in ink reservoir 110 decreases and float portion 471 is exposed from inside ink, float portion 471 moves downward following the falling level of the ink. When the amount of ink inside ink reservoir 110 is substantially no ink, float portion 471 touches bottom surface. Moreover, the downward movement of float portion 471 causes movable member 470 to rotate clockwise about attachment portion 472 and causes blocking portion 473*a* to be displaced upward. When blocking portion 473*a* is displaced upwards to a non-blocking position where it does not block the space between light emitting portion 1014*a* and light receiving portion 1014*b* of sensor 1014, light passes between light emitting portion 1014*a* and light receiving portion 1014*b*, and printer 1000 detects that ink cartridge 1 is out of ink and needs to be replaced.

Referring to FIG. 2, a case 200 may comprise a first case member 210 and a second case member 220, which sandwich ink storage element 100 in the width direction. First and second case members 210 and 220 may comprise a resin material and may be manufactured by injection molding.

First case member 210 and second case member 220 may have substantially same shape, and may have case cutout portions 211, 212, 221, and 222 formed therethrough. For example, case cutout portions 211, 212, 221, and 222 may be substantially semi-circular cutout portions. Case cutout portions 211 and 221 may expose a portion of ink supply portion 120 to the outside of case 200, and case cutout portions 212 and 222 may expose a portion of ambient air intake portion 130 to the outside of case 200. First case member 210 and second case member 220 also may have cutout portions 213 and 223 formed therethrough, which allow for the insertion of sensor 1014 to a position where it sandwiches translucent portion 140 at the side walls of translucent portion 140.

First and second case members 210 and 220 may be welded together and ink storage element 100 may be secured to case 200 at a pair of stepped areas. Specifically, a stepped area on the ink supply portion 120 side (the right front side in FIG. 2) may be a first case weld portion 216 and 226, and a stepped area on the ambient air intake portion 130 side (left rear side in FIG. 2) may be a second case weld portion 217 and 227. An engagement portion 226*a* extending in the short direction may be formed on the end of second case member 220 on the side opposite where case cutout portion 221 of first case weld portion 226 is formed, and second case weld portions 217 and 227 may have engagement portions 217*a* and 227*a* formed in a recessed shape.

Protector 300 may be a member which covers the surface of ink storage element 100 where ink supply portion 120 and ambient air intake portion 130 are provided, and protects ink supply portion 120 and ambient air intake portion 130 when ink cartridge 1 is shipped. Protector 300 may comprise a resin material and may be manufactured by injection molding. A protector through-hole 310 may be formed in protector 300 at a location corresponding to the ambient air intake portion 130 side, such that rod-shaped valve opening portion 132*a* of ambient air intake mechanism 132 may be protected.

Figure 7A:
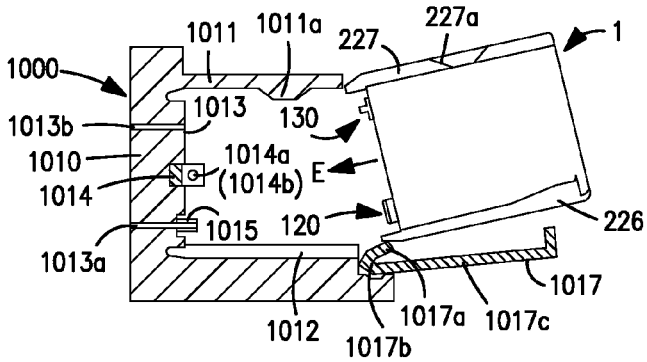
FIGS. 7(*a*)-7(*c*) are drawings depicting a method of installing the ink cartridge of FIG. 1 in a printer.
Figure 7B:
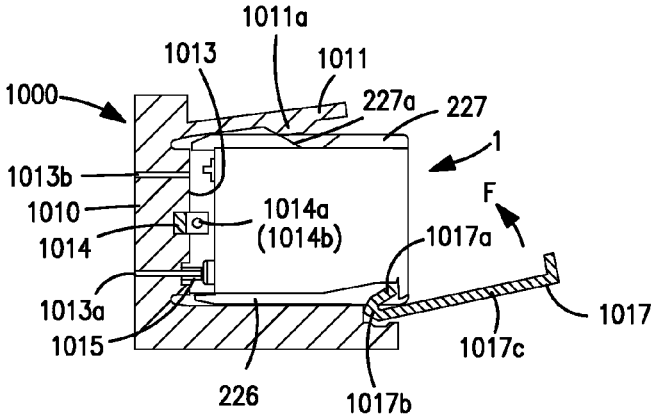
Figure 7C:
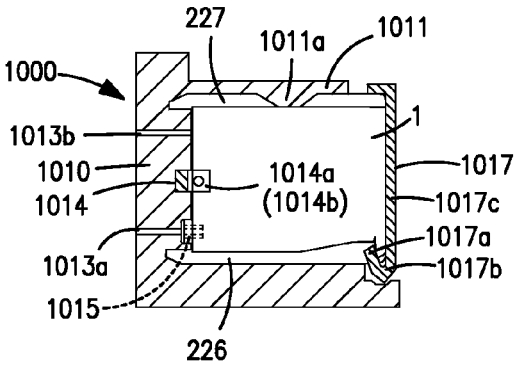

Referring to FIGS. 7(*a*) and 7(*b*), installation portion 1010 of printer 1000 may comprise an engagement rod 1011 which projects from installation surface 1013. Engagement rod 1011 may engage with engagement portions 217*a* and 227*a* of case 200. Installation portion 1010 also may comprise a support portion 1012 which supports first case weld portions 216 and 226 of case 200 from below, and may have a recessed shape matching the shape of first case weld portions 216 and 226. A convex portion 1011*a* may be formed on engagement rod 1011, which may protrude toward supporting portion 1012 and may have substantially same shape as engagement portions 217*a* and 227*a*.

Sensor 1014 may be arranged on installation surface 1013 of installation portion 1010. Sensor 1014 substantially may have a U-shape, and an open end of sensor 1014 may be light emitting portion 1014*a* and the other end of sensor 1014 may be light receiving portion 1014*b*. Light emitting portion 1014*a* and light receiving portion 1014*b* may be mounted projecting from installation surface 1013 so as to be inserted into through-holes formed by case cutout portions 213 and 223 and translucent portion 140 respectively. When light-receiving portion 1014*b* receives light emitted by light-emitting portion 1014*a*, a signal may not be output to a control substrate provided in printer 1000, and when light-receiving portion 1014*b* does not receive light emitted by light-emitting portion 1014*a*, a signal may be output to the control substrate, or vice versa.

On the bottom side of installation surface 1013 confronting ink supply portion 120, an ink extraction tube 1015 may be provided so as to project, and on the top side confronting air-introduction portion 130 of installation surface 1013, installation surface 1013 may be flat. An ink flow path 1013*a* may be connected to ink extraction tube 1015, and ink passing through ink flow path 1013*a* may be supplied to a discharge port (not shown). An air introduction path 1013*b* may be formed on installation surface 1013 of the air-introduction portion 130 side, and air passing through air-introduction path 1013*b* may be introduced into ink reservoir 110.

Moreover, installation portion 1010 may comprise a rotating engagement member 1017 which engages engagement portions 216*a* and 226*a* of case 200. Engagement member 1017 may comprise an engagement end 1017*a* which engages engagement portions 216*a* and 226*a*, a pivotal support portion 1017*b* which may be joined to engagement end 1017*a* and pivotally supports engagement member 1017, and a cover portion 1017*c* which may be joined to pivotal support portion 1017*b* and covers surface opposite surface of case 200 facing installation portion 1010.

Referring to FIG. 7(*a*), ink cartridge 1 may be installed in printer 1000 carried by inserting ink cartridge 1, such that first case 200 weld portions 216 and 226 contact support portion 1012, and pushing ink cartridge 1, such that first case weld portions 216 and 226 slide over support portion 1012 in direction of arrow E.

Referring to FIG. 7(*b*), when ink cartridge 1 is pushed inward, engagement rod 1011 may be depressed by second case weld portions 217 and 227 and may elastically deform away from support portion 1012. Moreover, engagement end portion 1017*a* of engagement member 1017 may contact engagement portions 216*a* and 226*a*, and engagement member 1017 may rotate upward in direction of arrow F.

Referring to FIG. 7(*c*), when ink cartridge 1 is pushed in further, protruding portion 1011*a* of engagement rod 1011 fits into and engages engagement portions 217*a* and 227*a* of case 200, thereby securing ink cartridge 1. Thus, when ink cartridge 1 is installed in installation portion 1010, ink cartridge 1 may be prevented from being dislodged.

Figure 9:
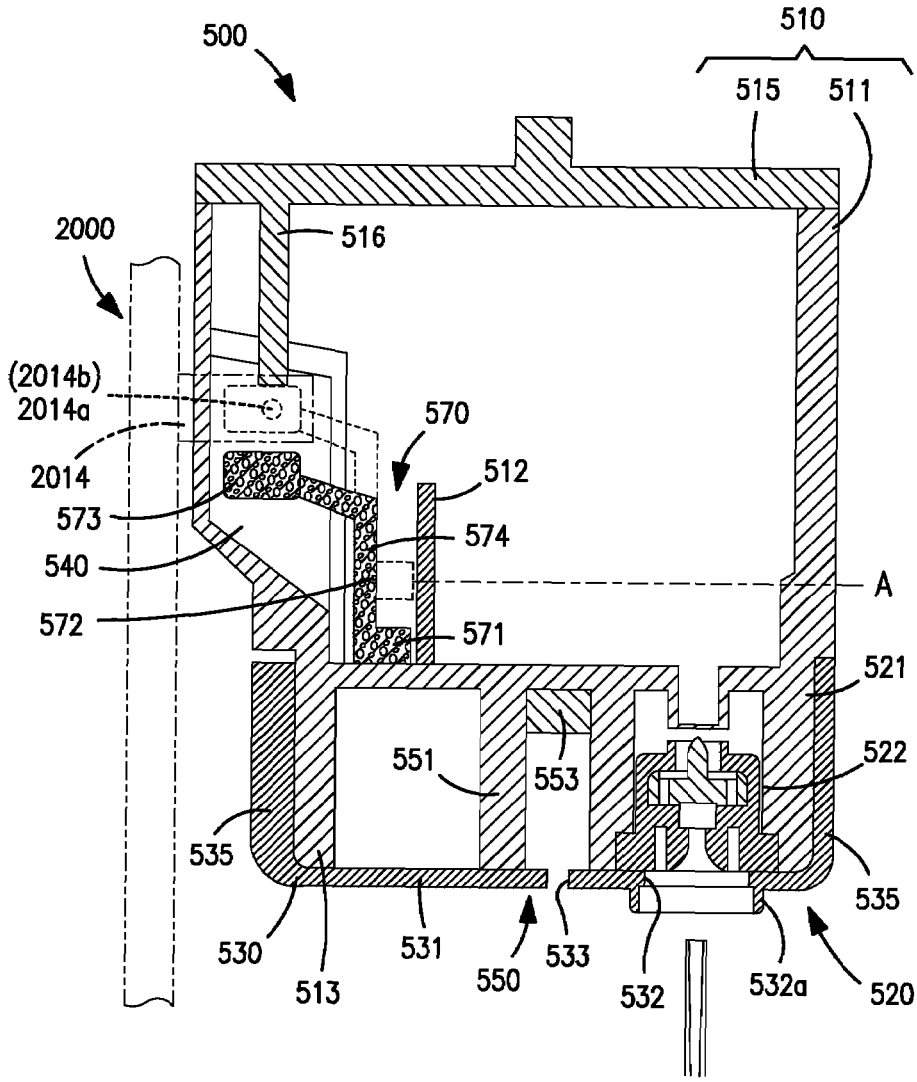
FIG. 9 is a drawing of an ink cartridge according to another embodiment of the present invention.

Referring to FIG. 9, another embodiment of present invention is depicted. This embodiment of the present invention is similar to the above-described embodiments of the present invention. Therefore, only the differences between this embodiment of the present invention and the above-described embodiments of the present invention are discussed with respect to this embodiment of the present invention.

Referring to FIG. 9, an ink cartridge 500 may comprise an ink reservoir 510 for storing ink, an ink supply portion 520 which may be arranged on a bottom wall of ink reservoir 510, an ink dispensing portion 550 for dispensing ink into ink reservoir 510, and a cap 530 which covers the bottom wall of ink reservoir 510.

Ink reservoir 510 may comprise a translucent bottomed box type main body portion 511 with an opening portion at top, and a cover element 515 which may be welded to main body portion 511 and may close the opening portion of main body portion 511, and an opaque displacement member 570 may be arranged therein. Displacement member 570 may comprise a material having a specific gravity which is less than the specific gravity of ink. Displacement member 570 may comprise a float portion 571, a connection portion 572 which extends vertically upward from float portion 571, and a blocking portion 573 which may be connected to the edge of connection portion 572 opposite float portion 571. Moreover, the ratio of volume of displacement member 570 occupied by float portion 571 may be selected, such that when float portion 571 is positioned within the ink, the buoyancy generated at displacement member 570 is greater than gravity, and when a portion of float portion 571 is exposed from the ink, e.g., when the ink level is below line A of FIG. 9, the buoyancy generated at displacement member 570 on float portion 571 may be substantially equal to gravity. The width of float portion 571 may be greater than width of the space formed inside translucent portion 540, and the width of connection portion 572 and blocking portion 573 may be less than the width of the space formed inside translucent portion 540. Moreover, a diffusion surface 574 may be formed over the entire surface of displacement member 570.

When ink cartridge 500 is installed in printer 2000, translucent portion 540 may be positioned between a light emitting portion 2014*a* and a light receiving portion 2014*b* of a sensor 2014 provided in printer 2000. A constraining wall 512 may be provided extending upward on the bottom surface of ink reservoir 510 near translucent portion 540. Specifically, constraining wall 512 may be provided at a position opposite the space inside translucent portion 540. Moreover, displacement member 570 may be arranged, such that float portion 571 is positioned between translucent portion 540 and constraining wall 512, and blocking portion 573 is positioned inside translucent portion 540. Therefore, constraining wall 512 may restrict the displacement path of displacement member 570 in the up-down direction.

Moreover, a constraining protrusion 516 may project into ink reservoir 510 on cover element 515. A portion of constraining protrusion 516 adjacent to its tip may be positioned in the space inside translucent portion 540, and a communication hole (not shown) for drawing air into ink reservoir 510 may be formed in cover element 515. Therefore, when a sufficient amount of ink is stored inside ink reservoir 510, the buoyancy generated on displacement member 570 is greater than gravity, and blocking portion 573 contacts the tip of constraining protrusion 516. Subsequently, when the ink in ink reservoir 510 decreases and the ink level drops to line A, the buoyancy generated on displacement member 570 may be equal to gravity. As ink level drops further, float portion 571 moves downward following the drop in the ink level, and blocking portion 573 also may be displaced downward. When the amount of ink in ink reservoir 510 is about zero, float portion 571 contacts bottom wall of ink reservoir 510, and blocking portion 573 moves to a non-blocking position In an embodiment of the present invention, ink supply portion 520 may comprise a cylindrical ink supply path 521 which communicates with ink reservoir 510 and extends in the up-down direction, and an ink supply mechanism 522 which may be incorporated into ink supply path 521. Ink dispensing portion 550 may comprise a cylindrical dispensing cylinder portion 551 which may be arranged on the bottom wall of ink reservoir 510 and may communicate with ink reservoir 510 and extend in the up-down direction. Ink dispensing portion 550 also may comprise an ink dispending cap 553 which may be press-fitted into dispensing cylinder portion 551.

Cap 530 may be opaque and may be fastened to ink reservoir 510 by ultrasound welding or like. Cap 530 may comprise a bottom wall 531 which faces the bottom wall of ink reservoir 510 and touches the ends of ink supply portion 521, and a dispensing cylinder portion 551 which projects downward from the bottom wall of ink reservoir 510 and the end of a rib 513 extending to the end of dispensing cylinder portion 551 and ink supply path 521 from bottom wall 531 of ink reservoir 510. Cap 530 also may comprise side walls 535 which extend upward from the edges of bottom wall 531 and contact a portion of the side surface of ink supply path 521, dispensing cylinder portion 551, and side surface of rib 513. In portions of bottom wall 531 corresponding to ink supply path 521 and dispensing cylinder portion 551, there may be provided openings 532 and 533. Moreover, an annular protrusion 532*a* that projects downward may be formed at the edge of opening 532 corresponding to ink supply path 521.

While the invention has been described in connection with exemplary embodiments, it will be understood by those skilled in art that other variations and modifications of the exemplary embodiments described above may be made without departing from the scope of invention. Other embodiments will be apparent to those skilled in art from a consideration of specification or practice of invention disclosed herein. It is intended that the specification and described examples are considered merely as exemplary of the invention, with true scope of the invention being indicated by flowing claims.

The invention claimed is:

1. An ink cartridge, comprising:

an ink chamber comprising a wall;

a translucent portion positioned at the wall, wherein the translucent portion has an inner space formed therein; and a movable member comprising:

a first member disposed within the inner space of the translucent member; and a second member disposed within the ink chamber, wherein at least one of the first member and an interior surface of the translucent portion comprises at least one protrusion portion, and at least one of a surface of the first member and the interior surface of the translucent portion comprises a first surface portion and a second surface portion, wherein the second surface portion is raised with respect to the first surface portion, wherein the first surface portion comprises a first flat surface, the second surface portion comprises a second flat surface and a plurality of projecting portions which extend a predetermined distance from the second flat surface, wherein a distance between a first protrusion of the plurality of projecting portions and a second protrusion of the plurality of projecting portions is less than about 0.6 mm.

2. The ink cartridge of claim 1, wherein the at least one protrusion portion comprises at least one pin.

3. The ink cartridge of claim 2, wherein an angular corner is formed at an intersection of each of the plurality of projecting portions and the first flat surface.

4. The ink cartridge of claim 3, wherein an angle of each of the angular corners is about 90 degrees.

5. The ink cartridge of claim 3, wherein each of the angular corners are configured to create a capillary effect, and the plurality of projecting portions are configured such that the angular corners draw ink away from the translucent portion due to the capillary effect.

6. The ink cartridge of claim 2, wherein the distance between the first protrusion and the second protrusion is less than about 0.4 mm.

7. The ink cartridge of claim 6, wherein a distance between each of the plurality of projecting portions and a most adjacent one of the plurality of projecting portions is less than about 0.4 mm.

8. The ink cartridge of claim 2, wherein the predetermined distance is between about 0.04 mm and about 0.06 mm.

9. The ink cartridge of claim 2, wherein the plurality of projecting portions are substantially cylindrical.

10. The ink cartridge of claim 1, wherein each of the surface of the first member and a surface of the second member comprises the first surface portion and the second surface portion.

11. The ink cartridge of claim 1, wherein each of the surface of the first member and the interior surface of the translucent portion comprises the first surface portion and the second surface portion.

12. The ink cartridge of claim 11, wherein a surface of the second member comprises the first surface portion and the second surface portion.

13. An ink cartridge, comprising:

an ink chamber comprising a wall;

a translucent portion positioned at the wall, wherein the translucent portion has an inner space formed therein; and a movable member comprising:

a first member disposed within the inner space of the translucent member; and a second member disposed within the ink chamber, wherein at least one of the first member and an interior surface of the translucent portion comprises at least one protrusion portion, and at least one of a surface of the first member and the interior surface of the translucent portion comprises a first surface portion and a second surface portion, wherein the second surface portion is raised with respect to the first surface portion, wherein the first surface portion comprises a first flat surface, the second surface portion comprises a second flat surface and a plurality of projecting portions which extend a predetermined distance from the second flat surface, wherein the predetermined distance is between about 0.04 mm and about 0.06 mm.

14. The ink cartridge of claim 13, wherein the at least one protrusion portion comprises at least one pin.

* * * * *